US006059128A

United States Patent [19]

Wang

[11] Patent Number: 6,059,128

[45] Date of Patent: May 9, 2000

[54] CORNER SHELF DEVICE

[76] Inventor: Fu-To Wang, 58, Ma Yuan West St., Taichung, Taiwan

[21] Appl. No.: 09/406,400

[22] Filed: Sep. 27, 1999

[51] Int. Cl.[7] ..... A47F 5/00

[52] U.S. Cl. ..... 211/90.01; 108/42

[58] Field of Search ..... 211/90.01, 90.02, 211/153; 108/42, 149, 152

[56] References Cited

U.S. PATENT DOCUMENTS

| | | | |
|---|---|---|---|
| 2,389,349 | 3/1945 | Eastman | 211/90.01 X |
| 2,465,635 | 8/1949 | Conterio | 108/42 |
| 2,828,044 | 3/1958 | Reiss et al. | 211/90.01 X |
| 3,033,376 | 5/1962 | Eastman | 108/42 |
| 4,555,082 | 11/1985 | Sack et al. | 108/42 X |
| 4,708,310 | 11/1987 | Smith | 211/90.01 X |
| 4,886,236 | 12/1989 | Randall | 211/90.01 X |
| 5,513,575 | 5/1996 | Slade | 108/42 |
| 5,588,370 | 12/1996 | Longley | 108/42 |
| 5,992,654 | 11/1999 | Dente | 211/90.01 |

*Primary Examiner*—Robert W. Gibson, Jr.

[57] ABSTRACT

A corner shelf device has a triangular base and a triangular cover. A first sucking disk, a second sucking disk, a third sucking disk, and a fourth sucking disk are disposed on the triangular cover. A first link plate, a second link plate, a first crisscross plate, and a second crisscross plate are disposed between the triangular cover and the triangular base. An oblong end of the first link plate and an oblong end of the second link plate are connected together. The first crisscross plate and the second crisscross plate are intersected. A first blade is disposed on a round end of the first link plate. A second blade is disposed on a round end of the second link plate. A third blade is disposed on a circular end of the first crisscross plate. A fourth blade is disposed on a circular end of the second crisscross plate.

1 Claim, 5 Drawing Sheets

CORNER SHELF DEVICE

BACKGROUND OF THE INVENTION

The present invention relates to a corner shelf device. More particularly, the present invention relates to a corner shelf device which can be disposed on an inner corner of a house without nails.

A conventional corner shelf device nedds a plurality of nails to fasten the conventional corner shelf device on an inner corner of a house.

SUMMARY OF THE INVENTION

An object of the present invention is to provide a corner shelf device which can be disposed on an inner corner of a house without nails.

Another object of the present invention is to provide a corner shelf device which has a pair of blades disposed on a pair of link plates and another pair of blades disposed on a pair of crisscross plates so that the blades can be inserted in fissures of tiles on a wall.

Another object of the present invention is to provide a corner shelf device which has two pairs of opposite sucking disks to suck tiles on a wall of an inner corner of a house.

Accordingly, a corner shelf device comprises a triangular base and a triangular cover engaging with the triangular base. The triangular cover has a camber-shaped bar, a plurality of inner threaded posts, a plurality of through apertures, a first notch, a second notch, a third notch, and a fourth notch. A plurality of positioning apertures are formed on the camber-shaped bar. A first sucking disk is disposed on a left lower side of the triangular cover. A second sucking disk is disposed on a right lower side of the triangular cover. A third sucking disk is disposed on a left upper side of the triangular cover. A fourth sucking disk is disposed on a right upper side of the triangular cover. The triangular base has a camber-shaped hole and a plurality of through holes matching the inner threaded posts. Each of the inner threaded posts is inserted in the respective through hole. A plurality of screws fasten the triangular base and the triangular cover together via the through holes and the inner threaded posts. A first link plate is disposed between the triangular cover and the triangular base. The first link plate has a first round end and a first oblong end. A plurality of first pillars are disposed on the first round end of the first link plate. A first oblong hole is formed on the first oblong end of the first link plate. A first hollow cylinder seat is disposed on the first oblong end of the first link plate. The first hollow cylinder seat has a bevel and a recess hole. A first blade is disposed on the first round end of the first link plate. The first blade has a first round hole. A first hollow positioning disk is disposed on the first round end of the first link plate to cover the first blade. The first hollow positioning disk has a plurality of first round apertures to receive the first pillars. The first hollow positioning disk, the first blade, and the first round end of the first link plate receive the respective inner threaded post. A second link plate is disposed between the triangular cover and the triangular base. The second link plate has a second round end and a second oblong end. A plurality of second pillars are disposed on the second round end of the second link plate. A second oblong hole is formed on the second oblong end of the second link plate. A second blade is disposed on the second round end of the second link plate. The second blade has a second round hole. A second hollow positioning disk is disposed on the second round end of the second link plate to cover the second blade. The second hollow positioning disk has a plurality of second round apertures to receive the second pillars. The second hollow positioning disk, the second blade, and the second round end of the second link plate receive the respective inner threaded post. A first crisscross plate is disposed between the triangular cover and the triangular base. The first crisscross plate has a first circular hole, a first distal end, and a first circular end. A plurality of third pillars are disposed on the first circular end of the first crisscross plate. A third blade is disposed on the first circular end of the first crisscross plate. The third blade has a third round hole. A third hollow positioning disk is disposed on the first circular end of the first crisscross plate to cover the third blade. The third hollow positioning disk has a plurality of third round apertures to receive the third pillars. The third hollow positioning disk, the third blade, and the first circular end of the first crisscross plate receive the respective inner threaded post. A second crisscross plate is disposed between the triangular cover and the triangular base. The second crisscross plate has a second circular hole, a second distal end, and a second circular end. A plurality of fourth pillars are disposed on the second circular end of the second crisscross plate. A fourth blade is disposed on the second circular end of the second crisscross plate. The fourth blade has a fourth round hole. A fourth hollow positioning disk is disposed on the second circular end of the second crisscross plate to cover the fourth blade. The fourth hollow positioning disk has a plurality of fourth round apertures to receive the fourth pillars. The fourth hollow positioning disk, the fourth blade, and the second circular end of the second crisscross plate receive the respective inner threaded post. The first crisscross plate and the second crisscross plate are intersected. A tension spring fastens the first crisscross plate and the second crisscross plate via the first circular hole of the first crisscross plate and the second circular hole of the second crisscross plate. The first hollow cylinder seat is inserted in the second oblong hole of the second oblong end of the second link plate. A swivel button has a positioning block inserted in the recess hole of the first hollow cylinder seat. A shaft is inserted in the first hollow cylinder seat. A compression spring is inserted in the first hollow cylinder seat. A washer is inserted in the first hollow cylinder seat. A retainer ring fastens a positioning plug on the washer. The positioning plug is inserted in one of the positioning apertures of the camber-shaped bar. A tip end of the first blade extends out of the triangular cover via the first notch. A tip end of the second blade extends out of the triangular cover via the second notch. A tip end of the third blade extends out of the triangular cover via the third notch. A tip end of the fourth blade extends out of the triangular cover via the fourth notch. The first distal end of the first crisscross plate blocks the first link plate. The second distal end of the second crisscross plate blocks the second link plate.

DETAILED DESCRIPTION OF THE INVENTION

Figure 1:
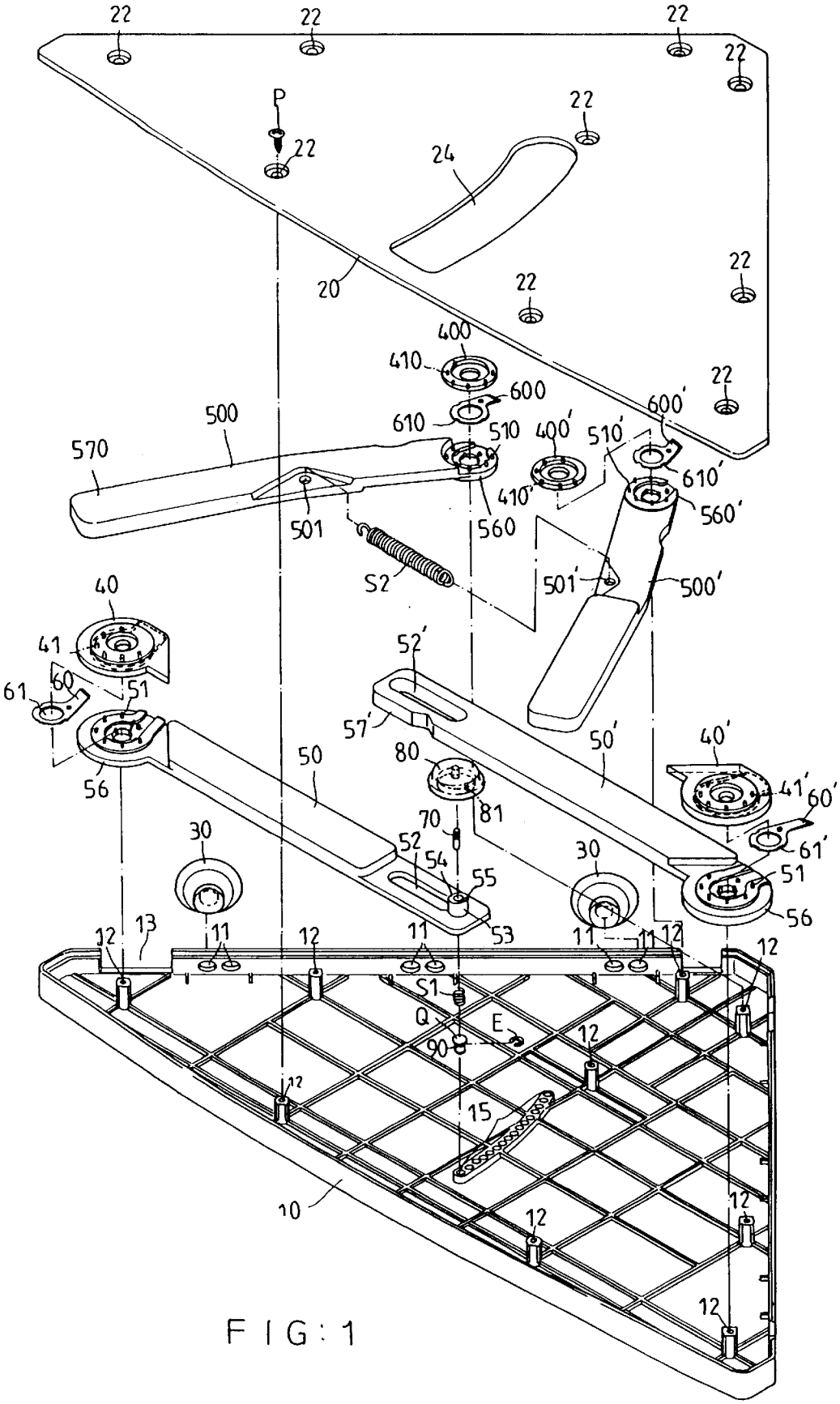
FIG. 1 is a perspective exploded view of a corner shelf device of a preferred embodiment in accordance with the present invention.
Figure 2:
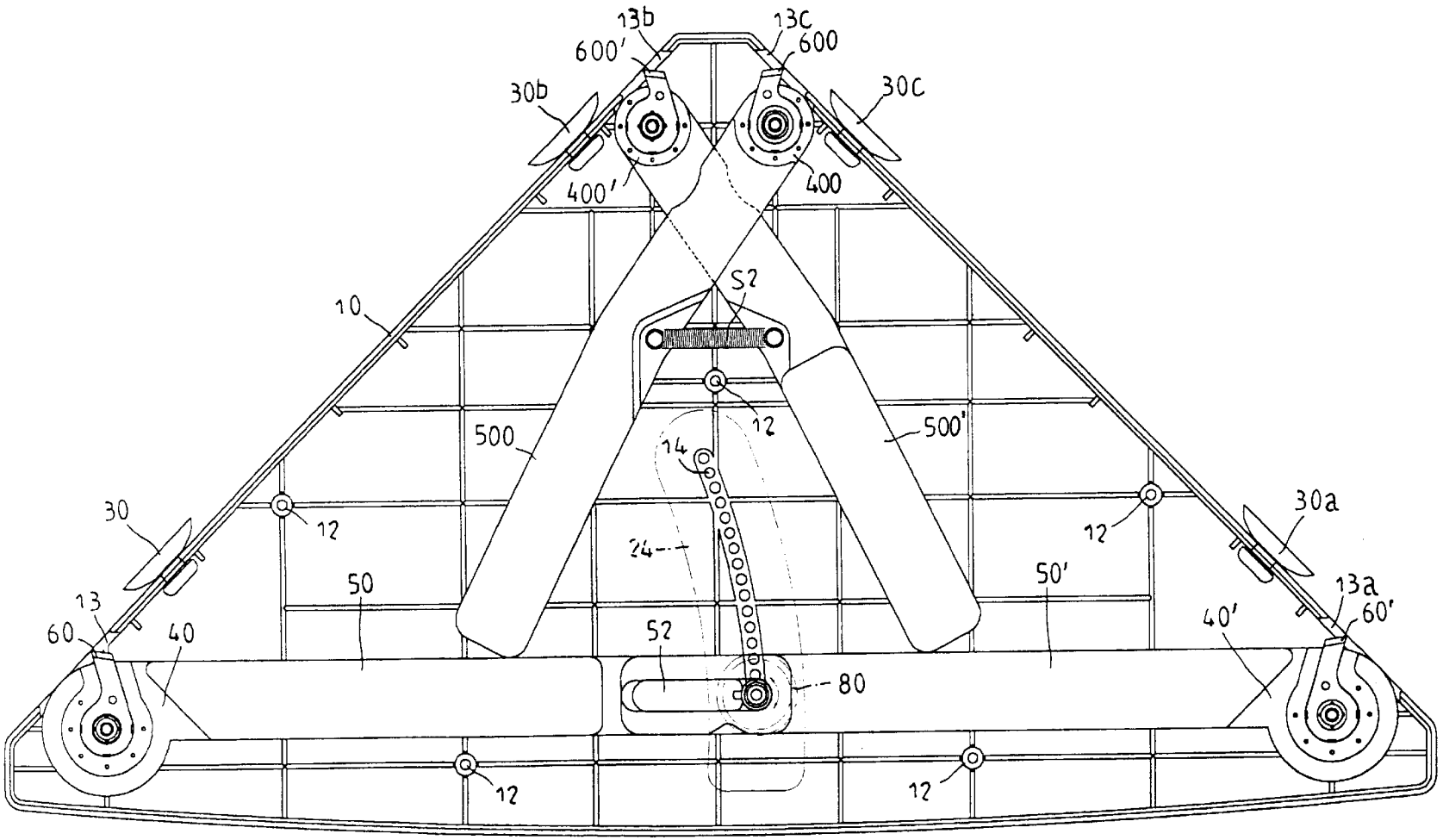
FIG. 2 is an elevational assembly view of a corner shelf device of a preferred embodiment in accordance with the present invention.
Figure 3:
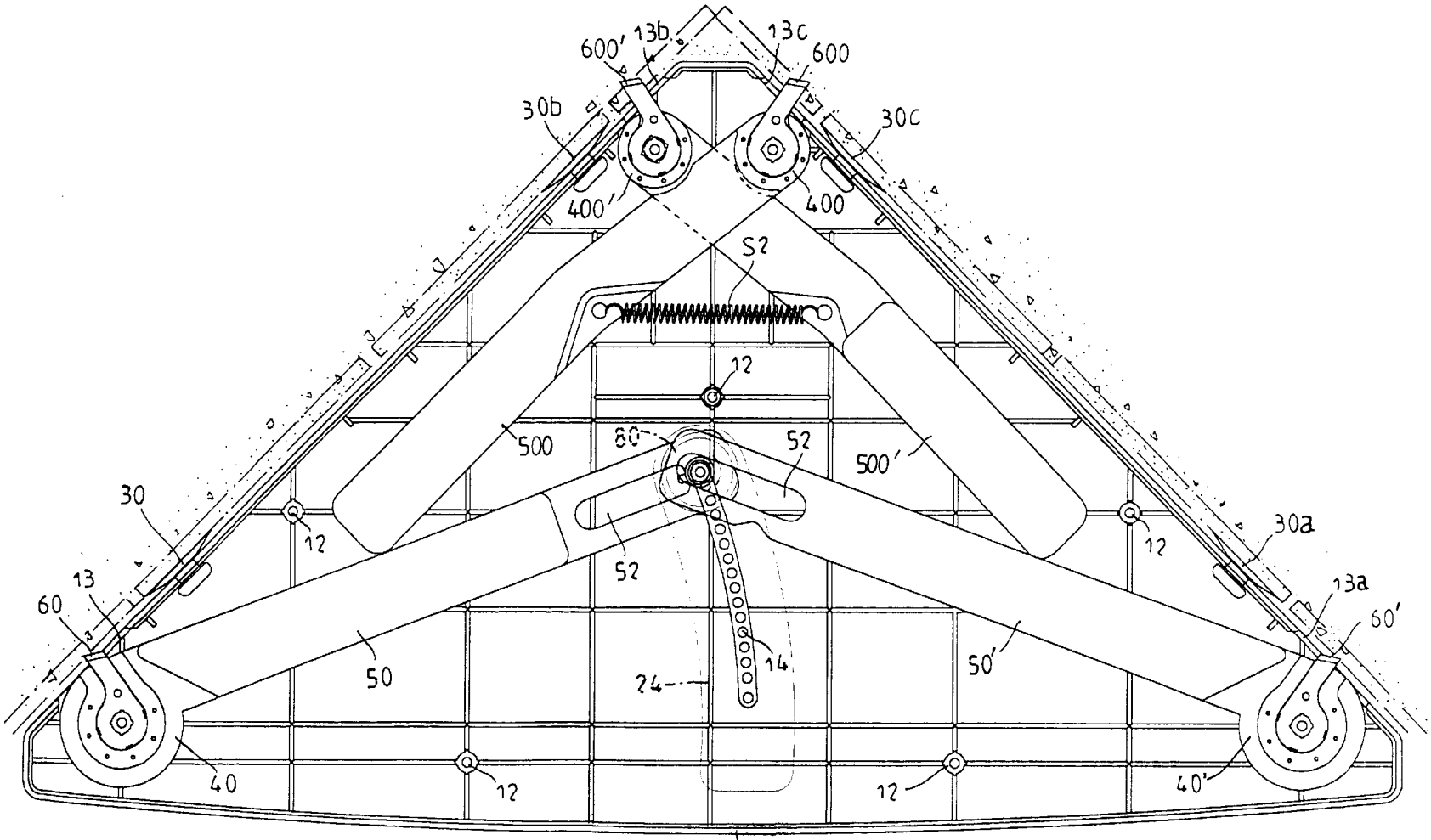
FIG. 3 is a schematic view illustrating an operation of a corner shelf device of a preferred embodiment in accordance with the present invention.
Figure 4:
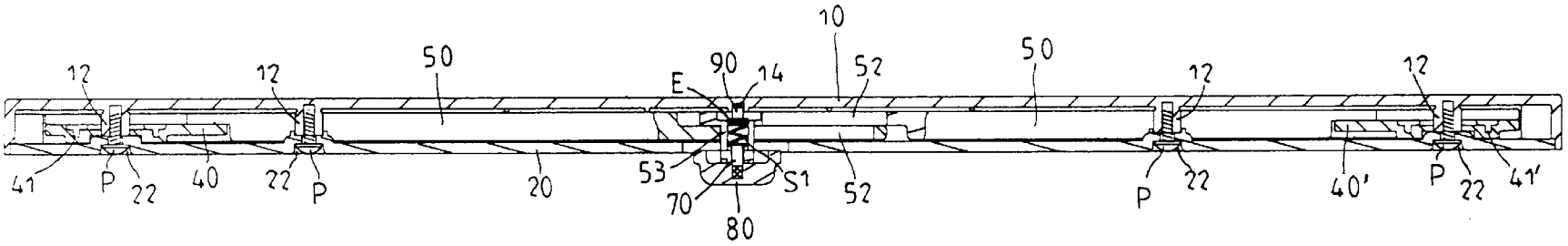
FIG. 4 is a sectional assembly view of a corner shelf device of a preferred embodiment in accordance with the present invention.
Figure 5:
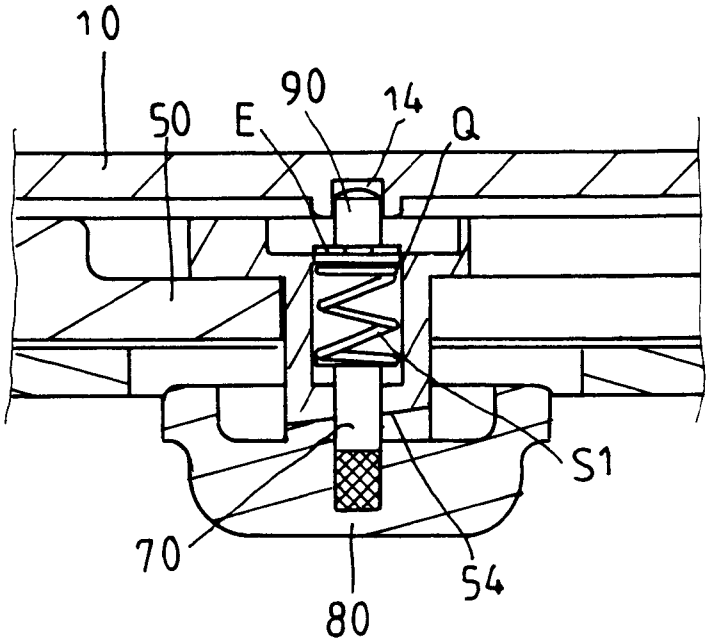
FIG. 5 is a sectional assembly view of a shaft, a first link plate, a compression spring, and a swivel button.

Referring to FIGS. 1 to 5, a corner shelf device comprises a triangular base 20 and a triangular cover 10 engaging with the triangular base 20.

The triangular cover 10 has a camber-shaped bar 15, a plurality of inner threaded posts 12, a plurality of through apertures 11, a first notch 13, a second notch 13*a*, a third notch 13*b*, and a fourth notch 13*c*.

A plurality of positioning apertures 14 are formed on the camber-shaped bar 15.

A first sucking disk 30 is disposed on a left lower side of the triangular cover 10.

A second sucking disk 30*a* is disposed on a right lower side of the triangular cover 10.

A third sucking disk 30*b* is disposed on a left upper side of the triangular cover 10.

A fourth sucking disk 30*c* is disposed on a right upper side of the triangular cover 10.

The triangular base 20 has a camber-shaped hole 24 and a plurality of through holes 22 matching the inner threaded posts 12. Each of the inner threaded posts 12 is inserted in the respective through hole 22. A plurality of screws P fasten the triangular base 20 and the triangular cover 10 together via the through holes 22 and the inner threaded posts 12.

A first link plate 50 is disposed between the triangular cover 10 and the triangular base 20. The first link plate 50 has a first round end 56 and a first oblong end 57. A plurality of first pillars 51 are disposed on the first round end 56 of the first link plate 50.

A first oblong hole 52 is formed on the first oblong end 57 of the first link plate 50.

A first hollow cylinder seat 53 is disposed on the first oblong end 57 of the first link plate 50. The first hollow cylinder seat 53 has a bevel 54 and a recess hole 55.

A first blade 60 is disposed on the first round end 56 of the first link plate 50. The first blade 60 has a first round hole 61.

A first hollow positioning disk 40 is disposed on the first round end 56 of the first link plate 50 to cover the first blade 60. The first hollow positioning disk 40 has a plurality of first round apertures 41 to receive the first pillars 51.

The first hollow positioning disk 40, the first blade 60, and the first round end 56 of the first link plate 50 receive the respective inner threaded post 12.

A second link plate 50' is disposed between the triangular cover 10 and the triangular base 20. The second link plate 50' has a second round end 56' and a second oblong end 57'. A plurality of second pillars 51' are disposed on the second round end 56' of the second link plate 50'.

A second oblong hole 52' is formed on the second oblong end 57' of the second link plate 50'.

A second blade 60' is disposed on the second round end 56' of the second link plate 50'. The second blade 60' has a second round hole 61'.

A second hollow positioning disk 40' is disposed on the second round end 56' of the second link plate 50' to cover the second blade 60'. The second hollow positioning disk 40' has a plurality of second round apertures 41' to receive the second pillars 51'.

The second hollow positioning disk 40', the second blade 60', and the second round end 56' of the second link plate 50' receive the respective inner threaded post 12.

A first crisscross plate 500 is disposed between the triangular cover 10 and the triangular base 20. The first crisscross plate 500 has a first circular hole 501, a first distal end 570, and a first circular end 560. A plurality of third pillars 510 are disposed on the first circular end 560 of the first crisscross plate 500.

A third blade 600 is disposed on the first circular end 560 of the first crisscross plate 500. The third blade 600 has a third round hole 610.

A third hollow positioning disk 400 is disposed on the first circular end 560 of the first crisscross plate 500 to cover the third blade 600. The third hollow positioning disk 400 has a plurality of third round apertures 410 to receive the third pillars 510.

The third hollow positioning disk 400, the third blade 600, and the first circular end 560 of the first crisscross plate 500 receive the respective inner threaded post 12.

A second crisscross plate 500' is disposed between the triangular cover 10 and the triangular base 20. The second crisscross plate 500' has a second circular hole 501', a second distal end 570', and a second circular end 560'. A plurality of fourth pillars 510' are disposed on the second circular end 560' of the second crisscross plate 500'.

A fourth blade 600' is disposed on the second circular end 560' of the second crisscross plate 500'. The fourth blade 600' has a fourth round hole 610'.

A fourth hollow positioning disk 400' is disposed on the second circular end 560' of the second crisscross plate 500' to cover the fourth blade 600'. The fourth hollow positioning disk 400' has a plurality of fourth round apertures 410' to receive the fourth pillars 510'.

The fourth hollow positioning disk 400', the fourth blade 600', and the second circular end 560' of the second crisscross plate 500' receive the respective inner threaded post 12.

The first crisscross plate 500 and the second crisscross plate 500' are intersected. A tension spring S2 fastens the first crisscross plate 500 and the second crisscross plate 500' via the first circular hole 501 of the first crisscross plate 500 and the second circular hole 501' of the second crisscross plate 500'.

The first hollow cylinder seat 53 is inserted in the second oblong hole 52' of the second oblong end 57' of the second link plate 50'.

A swivel button 80 has a positioning block 81 inserted in the recess hole 55 of the first hollow cylinder seat 53. A shaft 70 is inserted in the first hollow cylinder seat 53.

A compression spring S1 is inserted in the first hollow cylinder seat 53. A washer Q is inserted in the first hollow cylinder seat 53. A retainer ring E fastens a positioning plug 90 on the washer Q. The positioning plug 90 is inserted in one of the positioning apertures 14 of the camber-shaped bar 15.

A tip end of the first blade 60 extends out of the triangular cover 10 via the first notch 13.

A tip end of the second blade 60' extends out of the triangular cover 10 via the second notch 13*a*.

A tip end of the third blade 600 extends out of the triangular cover 10 via the third notch 13*b*.

A tip end of the fourth blade 600' extends out of the triangular cover 10 via the fourth notch 13*c*.

The first distal end 570 of the first crisscross plate 500 blocks the first link plate 50.

The second distal end 570' of the second crisscross plate 500' blocks the second link plate 50'.

Referring to FIGS. 2 and 3 again, the swivel button 80 can be moved along the positioning apertures 14 of the camber-shaped bar 15 until the tip end of the first blade 60, the tip end of the second blade 60', the tip end of the third blade 600, and the tip end of the fourth blade 600' are inserted in fissures of tiles on a wall.

The invention is not limited to the above embodiment but various modification thereof may be made. Further, various changes in form and detail may be made without departing from the scope of the invention.

I claim:

1. A corner shelf device comprising:

a triangular base, a triangular cover engaging with the triangular base, the triangular cover having a camber-shaped bar, a plurality of inner threaded posts, a plurality of through apertures, a first notch, a second notch, a third notch, and a fourth notch, a plurality of positioning apertures formed on the camber-shaped bar, a first sucking disk disposed on a left lower side of the triangular cover, a second sucking disk disposed on a right lower side of the triangular cover, a third sucking disk disposed on a left upper side of the triangular cover, a fourth sucking disk disposed on a right upper side of the triangular cover, the triangular base having a camber-shaped hole and a plurality of through holes matching the inner threaded posts, each of the inner threaded posts inserted in the respective through hole, a plurality of screws fastening the triangular base and the triangular cover together via the through holes and the inner threaded posts, a first link plate disposed between the triangular cover and the triangular base, the first link plate having a first round end and a first oblong end, a plurality of first pillars disposed on the first round end of the first link plate, a first oblong hole formed on the first oblong end of the first link plate, a first hollow cylinder seat disposed on the first oblong end of the first link plate, the first hollow cylinder seat having a bevel and a recess hole, a first blade disposed on the first round end of the first link plate, the first blade having a first round hole, a first hollow positioning disk disposed on the first round end of the first link plate to cover the first blade, the first hollow positioning disk having a plurality of first round apertures to receive the first pillars, the first hollow positioning disk, the first blade, and the first round end of the first link plate receiving the respective inner threaded post, a second link plate disposed between the triangular cover and the triangular base, the second link plate having a second round end and a second oblong end, a plurality of second pillars disposed on the second round end of the second link plate, a second oblong hole formed on the second oblong end of the second link plate, a second blade disposed on the second round end of the second link plate, the second blade having a second round hole, a second hollow positioning disk disposed on the second round end of the second link plate to cover the second blade, the second hollow positioning disk having a plurality of second round apertures to receive the second pillars, the second hollow positioning disk, the second blade, and the second round end of the second link plate receiving the respective inner threaded post, a first crisscross plate disposed between the triangular cover and the triangular base, the first crisscross plate having a first circular hole, a first distal end, and a first circular end, a plurality of third pillars disposed on the first circular end of the first crisscross plate, a third blade disposed on the first circular end of the first crisscross plate, the third blade having a third round hole, a third hollow positioning disk disposed on the first circular end of the first crisscross plate to cover the third blade, the third hollow positioning disk having a plurality of third round apertures to receive the third pillars, the third hollow positioning disk, the third blade, and the first circular end of the first crisscross plate receiving the respective inner threaded post, a second crisscross plate disposed between the triangular cover and the triangular base, the second crisscross plate having a second circular hole, a second distal end, and a second circular end, a plurality of fourth pillars disposed on the second circular end of the second crisscross plate, a fourth blade disposed on the second circular end of the second crisscross plate, the fourth blade having a fourth round hole, a fourth hollow positioning disk disposed on the second circular end of the second crisscross plate to cover the fourth blade, the fourth hollow positioning disk having a plurality of fourth round apertures to receive the fourth pillars, the fourth hollow positioning disk, the fourth blade, and the second circular end of the second crisscross plate receiving the respective inner threaded post, the first crisscross plate and the second crisscross plate being intersected, a tension spring fastening the first crisscross plate and the second crisscross plate via the first circular hole of the first crisscross plate and the second circular hole of the second crisscross plate, the first hollow cylinder seat inserted in the second oblong hole of the second oblong end of the second link plate, a swivel button having a positioning block inserted in the recess hole of the first hollow cylinder seat, a shaft inserted in the first hollow cylinder seat, a compression spring inserted in the first hollow cylinder seat, a washer inserted in the first hollow cylinder seat, a retainer ring fastening a positioning plug on the washer, the positioning plug inserted in one of the positioning apertures of the camber-shaped bar, a tip end of the first blade extending out of the triangular cover via the first notch, a tip end of the second blade extending out of the triangular cover via the second notch, a tip end of the third blade extending out of the triangular cover via the third notch, a tip end of the fourth blade extending out of the triangular cover via the fourth notch, the first distal end of the first crisscross plate blocking the first link plate, and the second distal end of the second crisscross plate blocking the second link plate.

* * * * *